US011975242B2

(12) United States Patent
Shindo et al.

(10) Patent No.: US 11,975,242 B2
(45) Date of Patent: May 7, 2024

(54) GOLF BALL

(71) Applicant: Sumitomo Rubber Industries, Ltd., Kobe (JP)

(72) Inventors: Ayaka Shindo, Kobe (JP); Takahiro Shigemitsu, Kobe (JP); Kazuyoshi Shiga, Kobe (JP); Toshiyuki Tarao, Kobe (JP); Takanobu Kawamura, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 18/077,562

(22) Filed: Dec. 8, 2022

(65) Prior Publication Data

US 2023/0201670 A1 Jun. 29, 2023

(30) Foreign Application Priority Data

Dec. 27, 2021 (JP) ..... 2021-212721

(51) Int. Cl.
*A63B 37/06* (2006.01)
*A63B 37/00* (2006.01)

(52) U.S. Cl.
CPC ..... *A63B 37/0039* (2013.01); *A63B 37/0012* (2013.01); *A63B 37/0031* (2013.01); *A63B 37/0076* (2013.01); *A63B 37/0024* (2013.01)

(58) Field of Classification Search
CPC ..... A63B 37/0023; A63B 37/0038
See application file for complete search history.

(56) References Cited

U.S. PATENT DOCUMENTS

| | | | | |
|---|---|---|---|---|
| 2017/0340922 | A1* | 11/2017 | Inoue | C08G 18/792 |
| 2018/0178080 | A1* | 6/2018 | Tanaka | A63B 37/0024 |
| 2018/0178081 | A1* | 6/2018 | Tanaka | A63B 37/0074 |
| 2019/0160340 | A1* | 5/2019 | Tarao | C08G 18/4833 |
| 2019/0282860 | A1* | 9/2019 | Tanaka | A63B 37/0024 |
| 2019/0290969 | A1* | 9/2019 | Tanaka | A63B 37/0039 |
| 2020/0114214 | A1* | 4/2020 | Tanaka | A63B 37/0074 |
| 2020/0114215 | A1* | 4/2020 | Tarao | A63B 37/0075 |

FOREIGN PATENT DOCUMENTS

| | | |
|---|---|---|
| JP | 2018-102692 A | 7/2018 |
| JP | 2018-102694 A | 7/2018 |

* cited by examiner

*Primary Examiner* — Raeann Gorden
(74) *Attorney, Agent, or Firm* — Birch, Stewart, Kolasch & Birch, LLP

(57) ABSTRACT

An object of the present disclosure is to provide a golf ball having good shot feeling and excellent durability and not having lowered resilience even if a hard cover material is used. The present disclosure provides a golf ball comprising a spherical core, and a cover disposed outside the spherical core and composed of one or more layers, wherein at least one cover layer contains (A) a base resin, and (B) at least one member selected from the group consisting of a polyrotaxane, a polyethylene oxide, a polypropylene oxide, a polycaprolactone and a liquid polymer, and Sa×Spc≥100 wherein Sa (μm) is an arithmetic mean roughness of a surface of a cut plane of the cover, and Spc ($mm^{-1}$) is an arithmetic mean curvature of a summit of the surface of the cut plane of the cover.

16 Claims, 2 Drawing Sheets

GOLF BALL

FIELD OF THE DISCLOSURE

The present disclosure relates to a technology for improving a cover of a golf ball.

DESCRIPTION OF THE RELATED ART

As a resin component constituting a cover or intermediate layer of a golf ball, a thermoplastic resin such as an ionomer resin or a polyurethane is used. The ionomer resin is highly rigid. When the ionomer resin is used for a constituent member of a golf ball, the resilience becomes high, and the obtained golf ball travels a great flight distance. Thus, the ionomer resin is widely used as a material of a cover or intermediate layer constituting a golf ball.

Further, not only a traveling performance but also a performance such as durability and shot feeling are desired for a golf ball.

JP 2018-102692 A discloses a golf ball comprising a spherical core and one or more cover layers disposed outside the spherical core, wherein at least one cover layer contains:

(A) a base resin containing (a-1) an ionomer resin and having a material hardness of 59 or more in Shore D hardness; and (B) a polyrotaxane having a cyclodextrin with at least a part of hydroxyl groups thereof being modified with a caprolactone chain via a —O—$C_3H_6$—O— group, a linear molecule piercing through a cyclic structure of the cyclodextrin, and blocking groups located at both terminals of the linear molecule to prevent disassociation of the cyclodextrin.

JP 2018-102694 A discloses a golf ball comprising a spherical core and one or more cover layers disposed outside the spherical core, wherein at least one cover layer contains:

(A) a base resin containing (a-1) an ionomer resin and having a material hardness of 58 or less in Shore D hardness; and (B) a polyrotaxane having a cyclodextrin with at least a part of hydroxyl groups thereof being modified with a caprolactone chain via a —O—$C_3H_6$—O— group, a linear molecule piercing through a cyclic structure of the cyclodextrin, and blocking groups located at both terminals of the linear molecule to prevent disassociation of the cyclodextrin.

SUMMARY OF THE DISCLOSURE

An object of the present disclosure is to provide a golf ball having good shot feeling and excellent durability without lowering resilience even if a hard cover material is used.

The present disclosure that has solved the above problem provides a golf ball comprising a spherical core, and a cover composed of one or more layers and disposed outside the spherical core, wherein at least one cover layer contains (A) a base resin, and (B) at least one member selected from the group consisting of a polyrotaxane, a polyethylene oxide, a polypropylene oxide, a polycaprolactone and a liquid polymer, and Sa×Spc≥100 is satisfied wherein Sa (μm) is an arithmetic mean roughness of a surface of a cut plane of the cover, and Spc ($mm^{-1}$) is an arithmetic mean peak curvature of peaks of the surface of the cut plane of the cover.

According to the present disclosure, a golf ball having good shot feeling and excellent durability without lowering resilience is obtained.

DESCRIPTION OF THE PREFERRED EMBODIMENT

Figure 1:
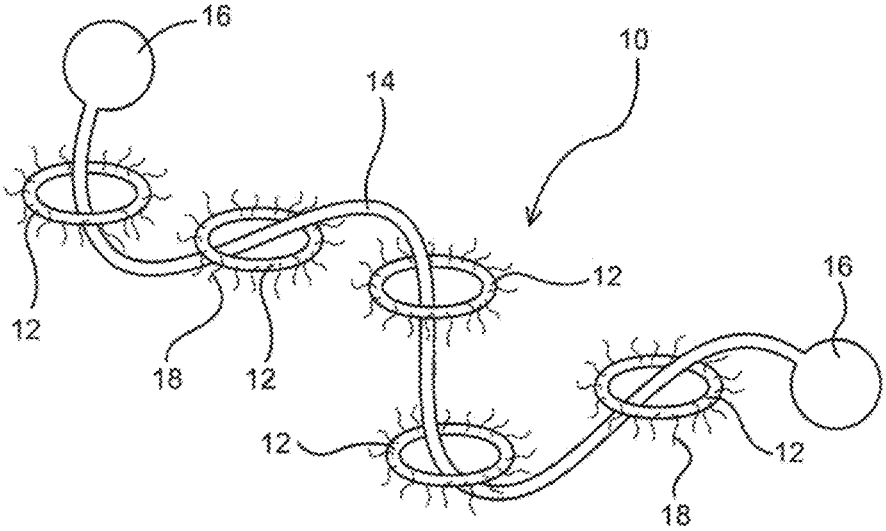
FIG. 1 is an illustrative drawing illustrating a molecular structure of one example of the polyrotaxane used in the present disclosure.

The present disclosure provides a golf ball comprising a spherical core, and a cover disposed outside the spherical core and composed of one or more layers, wherein at least one cover layer contains (A) a base resin, and (B) at least one member selected from the group consisting of a polyrotaxane, a polyethylene oxide, a polypropylene oxide, a polycaprolactone and a liquid polymer, and Sa×Spc≥100 is satisfied wherein Sa (μm) is an arithmetic mean roughness of a surface of a cut plane of the cover, and Spc ($mm^{-1}$) is an arithmetic mean peak curvature of peaks of the surface of the cut plane of the cover.

The golf ball according to the present disclosure comprises a spherical core, and a cover composed of one or more layers and disposed outside the spherical core, wherein Sa×Spc≥100 is satisfied wherein Sa (μm) is an arithmetic mean roughness of a surface of a cut plane of the cover, and Spc ($mm^{-1}$) is an arithmetic mean peak curvature of peaks of the surface of the cut plane of the cover.

The arithmetic mean roughness Sa (μm) of the surface of the cut plane of the cover, and the arithmetic mean peak curvature Spc ($mm^{-1}$) of peaks of the surface of the cut plane of the cover are determined by after-mentioned measuring methods.

In the present disclosure, Sa×Spc (μm/mm) is preferably 100 or more, more preferably 150 or more, and even more preferably 165 or more, and is preferably 1000 or less, more preferably 950 or less, and even more preferably 900 or less. If Sa×Spc (μm/mm) falls within the above range, the stress is diffused due to the fine dispersion of the additive (the component (B)), and the improvement effect of the durability is obtained.

The arithmetic mean roughness Sa (μm) of the surface of the cut plane of the cover is preferably 0.06 or more, more preferably 0.07 or more, and even more preferably 0.08 or more, and is preferably 0.50 or less, more preferably 0.45 or less, and even more preferably 0.40 or less. The arithmetic mean roughness Sa (μm) falling within the above range indicates that the necessary amount of additive is dispersed.

The arithmetic mean peak curvature Spc ($mm^{-1}$) of peaks of the surface of the cut plane of the cover is preferably 1300 or more, more preferably 1600 or more, and even more preferably 2500 or more, and is preferably 10000 or less, more preferably 9000 or less, and even more preferably 8000 or less. The arithmetic mean peak curvature Spc ($mm^{-1}$) of the peaks falling within the above range indicates that the additive is dispersed more finely.

At least one cover layer of the golf ball according to the present disclosure is preferably formed from a cover composition containing, as a resin component, (A) a base resin, and (B) at least one member selected from the group consisting of a polyrotaxane, a polyethylene oxide, a polypropylene oxide, a polycaprolactone and a liquid polymer. First, (A) the base resin used for the cover of the golf ball according to the present disclosure will be explained.

[(A) Base Resin]

(A) The base resin is not particularly limited, and may be either a thermoplastic resin or a thermosetting resin. (A) The base resin is preferably the thermoplastic resin.

Examples of (A) the base resin include a thermoplastic resin such as an ionomer resin, a polyurethane, a polyamide and a polyolefin; a thermoplastic elastomer such as a polyurethane elastomer, a styrene elastomer, a polyolefin elastomer, a polyamide elastomer and a polyester elastomer; a binary copolymer composed of an olefin and an α,β-unsaturated carboxylic acid having 3 to 8 carbon atoms such as an ethylene-(meth)acrylic acid copolymer; a ternary copolymer composed of an olefin, an α,β-unsaturated carboxylic acid having 3 to 8 carbon atoms and an α,β-unsaturated carboxylic acid ester such as an ethylene-(meth)acrylic acid-(meth) acrylic acid ester copolymer.

(A) The base resin used in the present disclosure is preferably a relatively hard resin. The material hardness of (A) the base resin is preferably 59 or more, more preferably 60 or more, and even more preferably 61 or more, and is preferably 69 or less, more preferably 68 or less, and even more preferably 67 or less in Shore D hardness. If the material hardness of (A) the base resin is 59 or more in Shore D hardness, the obtained golf ball has further enhanced resilience. In addition, if the material hardness of (A) the base resin is 69 or less in Shore D hardness, lowering in the durability due to repeated hitting is further suppressed. It is noted that the material hardness of the base resin is a slab hardness obtained by measuring a hardness of the base resin molded into a sheet form.

(A) The base resin preferably includes the ionomer resin and/or the polyamide.

Examples of the ionomer resin include an ionomer resin consisting of a metal ion-neutralized product of a binary copolymer composed of an olefin and an α,β-unsaturated carboxylic acid having 3 to 8 carbon atoms; an ionomer resin consisting of a metal ion-neutralized product of a ternary copolymer composed of an olefin, an α,β-unsaturated carboxylic acid having 3 to 8 carbon atoms and an α,β-unsaturated carboxylic acid ester; and a mixture thereof.

It is noted that, in the present disclosure, "an ionomer resin consisting of a metal ion-neutralized product of a binary copolymer composed of an olefin and an α,β-unsaturated carboxylic acid having 3 to 8 carbon atoms" is sometimes simply referred to as "a binary ionomer resin", and "an ionomer resin consisting of a metal ion-neutralized product of a ternary copolymer composed of an olefin, an α,β-unsaturated carboxylic acid having 3 to 8 carbon atoms and an α,β-unsaturated carboxylic acid ester" is sometimes simply referred to as "a ternary ionomer resin".

The olefin is preferably an olefin having 2 to 8 carbon atoms. Examples of the olefin include ethylene, propylene, butene, pentene, hexene, heptene and octene, and ethylene is particularly preferred. Examples of the α,β-unsaturated carboxylic acid having 3 to 8 carbon atoms include acrylic acid, methacrylic acid, fumaric acid, maleic acid and crotonic acid, and acrylic acid or methacrylic acid is particularly preferred. In addition, examples of the α,β-unsaturated carboxylic acid ester include a methyl ester, an ethyl ester, a propyl ester, a n-butyl ester, an isobutyl ester of acrylic acid, methacrylic acid, fumaric acid and maleic acid, and acrylic acid ester or methacrylic acid ester is particularly preferred.

As the binary ionomer resin, a metal ion-neutralized product of an ethylene-(meth)acrylic acid binary copolymer is preferable. As the ternary ionomer resin, a metal ion-neutralized product of a ternary copolymer composed of ethylene, (meth)acrylic acid and (meth)acrylic acid ester is preferable. Herein, (meth)acrylic acid means acrylic acid and/or methacrylic acid.

The amount of the α,β-unsaturated carboxylic acid component having 3 to 8 carbon atoms in the binary ionomer resin is preferably 5 mass % or more, more preferably 10 mass % or more, even more preferably 16 mass % or more, and most preferably 17 mass % or more, and is preferably 30 mass % or less, more preferably 25 mass % or less. This is because if the amount of the α,β-unsaturated carboxylic acid component having 3 to 8 carbon atoms is 5 mass % or more, the constituent member having a desirable hardness is easily obtained, and if the amount of the α,β-unsaturated carboxylic acid component having 3 to 8 carbon atoms is 30 mass % or less, the hardness of the obtained constituent member is not too high and thus the durability and the shot feeling of the golf ball are better.

The neutralization degree of the carboxyl groups of the binary ionomer resin is preferably 15 mole % or more, more preferably 20 mole % or more, and is preferably 90 mole % or less, more preferably 85 mole % or less. If the neutralization degree is 15 mole % or more, the obtained golf ball has better resilience and durability, and if the neutralization degree is 90 mole % or less, the cover material has better fluidity (better moldability). It is noted that the neutralization degree of the carboxyl groups of the binary ionomer resin may be calculated by the following expression.

Neutralization degree of binary ionomer resin (mole %)=100×(mole number of neutralized carboxyl groups in binary ionomer resin/mole number of all carboxyl groups in binary ionomer resin)

Examples of the metal ion for neutralizing at least a part of carboxyl groups of the binary ionomer resin include monovalent metal ions such as sodium, potassium and lithium; divalent metal ions such as magnesium, calcium, zinc, barium and cadmium; trivalent metal ions such as aluminum; and other ions such as tin and zirconium. As the binary ionomer resin, a mixture consisting of a sodium-neutralized binary ionomer resin and a zinc-neutralized binary ionomer resin is preferably used. Using the mixture further enhances the resilience and the durability.

Specific examples of the binary ionomer resin include trade names of "Himilan (registered trademark) (e.g. Himilan 1555 (Na), Himilan 1557 (Zn), Himilan 1605 (Na), Himilan 1702 (Zn), Himilan 1706 (Zn), Himilan 1707 (Na), Himilan AM7311 (Mg), Himilan AM7329 (Zn), Himilan AM7337 (Na))" available from Mitsui-Du Pont Polychemicals Co., Ltd.

Specific examples of the binary ionomer resin further include trade names of "Surlyn (registered trademark) (e.g. Surlyn 8945 (Na), Suriyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Suriyn 7930 (Li), Surlyn 7940 (Li), Surlyn AD8546 (Li))" available from E.I. du Pont de Nemours and Company.

Specific examples of the binary ionomer resin further include trade names of "lotek (registered trademark) (e.g.

lotek 8000 (Na), lotek 8030 (Na), lotek 7010 (Zn), lotek 7030 (Zn))" available from ExxonMobil Chemical Corporation.

The above listed binary ionomer resin may be used solely, or at least two of them may be used in combination. It is noted that Na, Zn, Li, Mg and the like described in the parentheses after the trade names indicate metal types of neutralizing metal ions of the binary ionomer resins.

The bending stiffness of the binary ionomer resin is preferably 140 MPa or more, more preferably 150 MPa or more, and even more preferably 160 MPa or more, and is preferably 550 MPa or less, more preferably 500 MPa or less, and even more preferably 450 MPa or less. If the bending stiffness falls within the above range, the spin rate on driver shots is optimized and thus the flight performance is excellent, and the durability is also better.

The melt flow rate (190° C., 2.16 kgf) of the binary ionomer resin is preferably 0.1 g/10 min or more, more preferably 0.5 g/10 min or more, and even more preferably 1.0 g/10 min or more, and is preferably 30 g/10 min or less, more preferably 20 g/10 min or less, and even more preferably 15 g/10 min or less. If the melt flow rate (190° C., 2.16 kgf) of the binary ionomer resin is 0.1 g/10 min or more, the cover material has better fluidity, and thus, for example, a thin cover can be obtained. In addition, if the melt flow rate (190° C., 2.16 kgf) of the binary ionomer resin is 30 g/10 min or less, the obtained golf ball has better durability.

The amount of the α,β-unsaturated carboxylic acid component having 3 to 8 carbon atoms in the ternary ionomer resin is preferably 2 mass % or more, more preferably 3 mass % or more, and is preferably 30 mass % or less, more preferably 25 mass % or less.

The neutralization degree of the carboxyl groups of the ternary ionomer resin is preferably 20 mole % or more, more preferably 30 mole % or more, and is preferably 90 mole % or less, more preferably 85 mole % or less. If the neutralization degree is 20 mole % or more, the obtained golf ball has better resilience and durability, and if the neutralization degree is 90 mole % or less, the cover material has better fluidity (better moldability). It is noted that the neutralization degree of the carboxyl groups of the ionomer resin may be calculated by the following expression.

Neutralization degree of ionomer resin (mole %)=100×(mole number of neutralized carboxyl groups in ionomer resin/mole number of all carboxyl groups in ionomer resin)

Examples of the metal ion for neutralizing at least a part of carboxyl groups of the ternary ionomer resin include monovalent metal ions such as sodium, potassium and lithium; divalent metal ions such as magnesium, calcium, zinc, barium and cadmium; trivalent metal ions such as aluminum; and other ions such as tin and zirconium.

Specific examples of the ternary ionomer resin include trade names of "Himilan (registered trademark) (e.g. Himilan AM7327 (Zn), Himilan 1855 (Zn), Himilan 1856 (Na), Himilan AM7331 (Na))" available from Mitsui-Du Pont Polychemicals Co., Ltd.; trade names of "Surlyn 6320 (Mg), Suriyn 8120 (Na), Suriyn 8320 (Na), Surlyn 9320 (Zn), Surlyn 9320W (Zn))" available from E.I. du Pont de Nemours and Company; and trade names of "lotek 7510 (Zn), lotek 7520 (Zn))" available from ExxonMobil Chemical Corporation. It is noted that Na, Zn, Mg and the like described in the parentheses after the trade names indicate metal types of neutralizing metal ions of the ternary ionomer resins. The ternary ionomer resin may be used solely, or at least two of them may be used in combination.

The bending stiffness of the ternary ionomer resin is preferably 10 MPa or more, more preferably 11 MPa or more, and even more preferably 12 MPa or more, and is preferably 100 MPa or less, more preferably 97 MPa or less, and even more preferably 95 MPa or less. If the bending stiffness falls within the above range, the spin rate on driver shots is optimized and thus the flight performance is excellent, and the durability is also better.

The melt flow rate (190° C., 2.16 kgf) of the ternary ionomer resin is preferably 0.1 g/10 min or more, more preferably 0.3 g/10 min or more, and even more preferably 0.5 g/10 min or more, and is preferably 20 g/10 min or less, more preferably 15 g/10 min or less, and even more preferably 10 g/10 min or less. If the melt flow rate (190° C., 2.16 kgf) of the ternary ionomer resin is 0.1 g/10 min or more, the cover material has better fluidity, and thus, for example, a thin constituent member can be obtained. In addition, if the melt flow rate (190° C., 2.16 kgf) of the ternary ionomer resin is 20 g/10 min or less, the obtained golf ball has better durability.

The polyamide is not particularly limited, as long as it is a thermoplastic resin having a plurality of amide bonds (—NH—CO—) in the main chain of the molecule. Examples of the polyamide include a product having amide bonds in the molecule, formed by a ring-opening polymerization reaction of a lactam, or a reaction between a diamine component and a dicarboxylic acid component.

Examples of the polyamide include an aliphatic polyamide such as polyamide 6, polyamide 11, polyamide 12, polyamide 66, polyamide 610, polyamide 6T, polyamide 61, polyamide 9T, polyamide M5T and polyamide 612; and an aromatic polyamide such as poly-p-phenylene terephthalamide and poly-m-phenylene isophthalamide. These polyamides may be used solely, or two or more of them may be used in combination. Among them, the aliphatic polyamide such as polyamide 6, polyamide 66, polyamide 11, and polyamide 12 is preferred.

Specific examples of the polyamide include trade names of "Rilsan (registered trademark) B (e.g. Rilsan BESN TL, Rilsan BESN P20 TL, Rilsan BESN P40 TL, Rilsan MB3610, Rilsan BMF O, Rilsan BMN O, Rilsan BMN O TLD, Rilsan BMN BK TLD, Rilsan BMN P20 D, Rilsan BMN P40 D)" available from Arkema Inc.

Next, the component (B) will be explained. The component (B) includes at least one member selected from the group consisting of (b1) a polyrotaxane, (b2) a polyethylene oxide, (b3) a polypropylene oxide, (b4) a polycaprolactone, and (b5) a liquid polymer.

In the present disclosure, as the component (B), (b1) the polyrotaxane and/or (b2) the polyethylene oxide is preferably used, (b2) the polyethylene oxide is more preferably used. (b2) The polyethylene oxide is finely dispersed in (A) the base resin, and further enhances the durability of the obtained golf ball.

[(b1) Polyrotaxane]

(b1) The polyrotaxane has a cyclodextrin, a linear molecule piercing through the cyclic structure of the cyclodextrin in a skewering manner, and blocking groups located at both terminals of the linear molecule to prevent disassociation of the cyclic molecule. The polyrotaxane is viscoelastic, because the cyclodextrin molecule is movable along the linear molecule that penetrates the cyclodextrin in a skewering manner (pulley effect). Even if a tension is applied to the polyrotaxane, the tension can be uniformly dispersed due to the pulley effect.

The cyclodextrin is a general term for an oligosaccharide having a cyclic structure. The cyclodextrin is, for example, a molecule having 6 to 8 D-glucopyranose residues being linked in a cyclic shape via an α-1,4-glucoside bond. Examples of the cyclodextrin include α-cyclodextrin (number of glucose units: 6), β-cyclodextrin (number of glucose units: 7), and γ-cyclodextrin (number of glucose units: 8), and α-cyclodextrin is preferable. As the cyclodextrin, one type may be used solely, and two or more types may be used in combination.

The linear molecule is not particularly limited, as long as a linear molecule pierces through the cyclic structure of the cyclodextrin in a skewering manner so that the cyclic structure of the cyclodextrin is rotatable around the linear molecule. Examples of the linear molecule include polyalkylene, polyester, polyether, and polyacrylic acid. Among them, polyether is preferable, polyethylene glycol is particularly preferable. Polyethylene glycol has less steric hindrance, and thus easily penetrates the cyclic structure of the cyclodextrin in a skewering manner.

The weight average molecular weight of the linear molecule is preferably 5,000 or more, more preferably 6,000 or more, and is preferably 100,000 or less, more preferably 80,000 or less.

The linear molecule preferably has functional groups at both terminals thereof. When the linear molecule has the functional group, the linear molecule easily reacts with the blocking group. Examples of the functional group include a hydroxyl group, a carboxyl group, an amino group, and a thiol group.

The blocking group is not particularly limited, as long as the blocking groups are located at both terminals of the linear molecule to prevent disassociation of the cyclodextrin from the linear molecule. Examples of the method for preventing the disassociation include a method of using a bulky blocking group to physically prevent the disassociation, and a method of using an ionic blocking group to electrostatically prevent the disassociation. Examples of the bulky blocking group include a cyclodextrin and an adamantyl group. The number of the cyclodextrins penetrated by the linear molecule preferably ranges from 0.06 to 0.61, more preferably ranges from 0.11 to 0.48, and even more preferably ranges from 0.24 to 0.41, when the maximum number thereof is deemed as 1. This is because if the number is less than 0.06, the pulley effect may not be exerted, and if the number exceeds 0.61, the cyclodextrins are very densely located, so that the movability of the cyclodextrin may decrease.

(b1) The polyrotaxane used in the present disclosure is preferably a polyrotaxane having at least a part of hydroxyl groups of the cyclodextrin being modified with a caprolactone chain. Modifying with the caprolactone increases the softness of the cover layer, thereby obtaining better shot feeling.

As the above modification, for example, the hydroxyl groups of the cyclodextrin are treated with propylene oxide to hydroxypropylate the cyclodextrin, and then ε-caprolactone is added to perform ring-opening polymerization. As a result of this modification, the caprolactone chain —(CO$(CH_2)_5$O)nH (n is a natural number of 1 to 100) is linked to the exterior side of the cyclic structure of the cyclodextrin via —O—$C_3H_6$—O— group. "n" represents the degree of polymerization, and is preferably a natural number of 1 to 100, more preferably a natural number of 2 to 70, and even more preferably a natural number of 3 to 40. At another terminal of the caprolactone chain, a hydroxyl group is formed through the ring-opening polymerization.

The ratio of the hydroxyl groups modified with the caprolactone chain to all the hydroxyl groups (100 mole %) included in the cyclodextrin before the modification is preferably 2 mole % or more, more preferably 5 mole % or more, and even more preferably 10 mole % or more, and is preferably 50 mole % or less, more preferably 30 mole % or less, and even more preferably 20 mole % or less. If the ratio of the hydroxyl groups modified with the caprolactone chain falls within the above range, the polyrotaxane has further enhanced compatibility with the base resin.

FIG. 1 is an illustrative drawing illustrating a molecular structure of one example of (b1) the polyrotaxane. A polyrotaxane 10 has a cyclodextrin 12, a linear molecule 14 piercing through the cyclic structure of the cyclodextrin 12, and blocking groups 16 located at both terminals of the linear molecule 14 to prevent disassociation of the cyclodextrin 12, and a caprolactone chain 18 is linked to the exterior side of the cyclic structure of the cyclodextrin 12 via —O—$C_3H_6$—O— group (not shown).

The hydroxyl value of (b1) the polyrotaxane is preferably 10 mg KOH/g or more, more preferably 15 mg KOH/g or more, and even more preferably 20 mg KOH/g or more, and is preferably 400 mg KOH/g or less, more preferably 300 mg KOH/g or less, even more preferably 220 mg KOH/g or less, and particularly preferably 180 mg KOH/g or less. If the hydroxyl value of the polyrotaxane falls within the above range, the polyrotaxane has further enhanced compatibility with the ionomer resin. It is noted that the hydroxyl value can be measured according to JIS K 1557-1, for example, by an acetylation method.

The total molecular weight of (b1) the polyrotaxane is preferably 30,000 or more, more preferably 40,000 or more, and even more preferably 50,000 or more, and is preferably 3,000,000 or less, more preferably 2,500,000 or less, and even more preferably 2,000,000 or less, in a weight average molecular weight. If the weight average molecular weight is 30,000 or more, the cover composition has better elasticity, and if the weight average molecular weight is 3,000,000 or less, the cover composition has enhanced softness, thereby obtaining better shot feeling. It is noted that the weight average molecular weight can be measured, for example, by gel permeation chromatography (GPC) using polystyrene as a standard substance, tetrahydrofuran as an eluent, and an organic solvent system GPC column (e.g., "Shodex (registered trademark) KF series" available from Showa Denko K.K.) as a column.

Specific examples of the polyrotaxane modified with the polycaprolactone include SeRM (registered trademark) super polymer SH3400P, SH2400P, and SH1300P available from by Advanced Softmaterials Inc.

[(b2) Polyethylene Oxide (Polyethylene Glycol) and (b3) Polypropylene Oxide (Polypropylene Glycol)]

(b2) The polyethylene oxide (polyethylene glycol) is a polymer having oxyethylene as a repeating unit. (b3) The polypropylene oxide (polypropylene glycol) is a polymer having oxypropylene as a repeating unit.

Examples of (b2) the polyethylene oxide (polyethylene glycol) and (b3) the polypropylene oxide (polypropylene glycol) include a product obtained by an addition polymerization of ethylene oxide or propylene oxide with one type or at least two types of a compound having two or more groups (—NH— or —OH) with an active hydrogen atom as an initiator.

As the initiator, one type or at least two types are used. Examples of the initiator include a compound having two hydroxy groups such as ethylene glycol, diethylene glycol, triethylene glycol, propylene glycol, trimethylene glycol, 1,3-butanediol, 1,4-butanediol, 1,6-hexanediol, and bisphenol A; and a compound having three hydroxy groups such as glycerin, trimethylolethane, and trimethylolpropane.

(b2) The polyethylene oxide (polyethylene glycol) is a polymer obtained by ring-opening polymerization of ethylene oxide, and preferably has hydroxy groups at both terminals. (b2) The polyethylene oxide used in the present disclosure excludes the polyethylene glycol having the blocking groups at both terminals used as the axis molecule of the polyrotaxane.

The number average molecular weight of (b2) the polyethylene oxide (polyethylene glycol) and (b3) the polypropylene oxide (polypropylene glycol) is preferably 400 or more, more preferably 700 or more, and even more preferably 1000 or more, and is preferably 7,000,000 or less, more preferably 6,000,000 or less, and even more preferably 5,000,000 or less.

[(b4) Polycaprolactone]

The polycaprolactone is obtained, for example, by ring-opening addition polymerization of a lactone monomer such as ε-caprolactone monomer in the presence of an initiator having an active hydrogen group and a catalyst. The polycaprolactone is obtained by conducting the reaction at a reaction temperature ranging from 120° C. to 220° C., preferably ranging from 150° C. to 200° C. for several hours while stirring. The reaction is preferably conducted under an inert gas.

Examples of the polymerization initiator include an alkylene glycol such as ethylene glycol, propylene glycol, 1,4-butanediol, 2,3-butylene glycol, pentamethylene glycol, and hexamethylene glycol; an aromatic diol such as isophthalyl alcohol, terephthalyl alcohol, β,β'-bishydroxyethyl terephthalate, and β,β'-bishydroxyethylisophthalate; an alicyclic diol such as cyclohexane 1,4-diol, and cyclohexane 1,4-dimethanol; polyethylene glycol, polypropylene glycol, polytetramethylene glycol, polyethylene adipate diol, polypropylene adipate diol, polybutylene adipate diol, polyethylene sebacate diol, polyethylene propylene diol, and polyethylene butylene adipate diol.

Examples of the catalyst include tetrabutyl titanate, tetraisopropyl titanate, tetraethyl titanate, dibutyl tin oxide, dibutyl tin laurate, tin octoate, and tin chloride.

The number average molecular weight of (b4) the polycaprolactone is preferably 1000 or more, more preferably 2000 or more, and even more preferably 3000 or more, and is preferably 1,000,000 or less, more preferably 900,000 or less, and even more preferably 800,000 or less.

[(b5) Liquid Polymer]

Next, (b5) the liquid polymer used in the present disclosure will be explained. (b5) The liquid polymer is a polymer being liquid at normal temperature (23° C.). Examples of (b5) the liquid polymer include a liquid polybutene, a liquid polyisoprene, a liquid polybutadiene, a liquid poly α-olefin, a liquid ethylene-α-olefin copolymer, a liquid ethylene-propylene copolymer, and a liquid ethylene-butylene copolymer. Among them, the liquid polybutene or liquid polybutadiene is preferable, the liquid polybutene is more preferable.

The liquid polybutene is not particularly limited, as long as the liquid polybutene is a polymer having butene as a main constituent component, and examples thereof include a polymer having 1-butene as a main constituent component, and a polymer (liquid polyisobutene) having isobutene as a main constituent component. In the present disclosure, as the liquid polybutene, the liquid polyisobutene is preferably used.

The liquid polyisobutene is not particularly limited, as long as the liquid polyisobutene is a polymer having isobutene as a main constituent component. The liquid polyisobutene may be a polymer including only isobutene as the constituent component. As the liquid polyisobutene, for example, a copolymer having a molecular structure of a long chain hydrocarbon obtained by reacting n-butene with the main component isobutene (e.g. Polybutene HV available from JXTG Nippon Oil & Energy Corporation) is preferably used.

As the liquid polybutene, a hydrogenated product of the above-mentioned polybutene (hydrogenated liquid polybutene) may also be used.

(b5) The liquid polymer may be used solely, or two or more of them may be used in combination.

The kinetic viscosity of (b5) the liquid polymer at 40° C. is preferably 900 $mm^2/s$ or more, more preferably 2000 $mm^2/s$ or more, and even more preferably 3000 $mm^2/s$ or more, and is preferably 100000 $mm^2/s$ or less, more preferably 50000 $mm^2/s$ or less, and even more preferably 30000 $mm^2/s$ or less. If the kinetic viscosity at 40° C. falls within the above range, there is no bleed out of a low molecular weight component and no problem during a process, thus a better rubber is obtained.

The kinetic viscosity of (b5) the liquid polymer at 100° C. is preferably 50 $mm^2/s$ or more, more preferably 60 $mm^2/s$ or more, even more preferably 70 $mm^2/s$ or more, and most preferably 150 $mm^2/s$ or more, and is preferably 4000 $mm^2/s$ or less, more preferably 3000 $mm^2/s$ or less, and even more preferably 2000 $mm^2/s$ or less. If the kinetic viscosity at 100° C. falls within the above range, there is no bleed out of a low molecular weight component, and no problem during a process.

The kinetic viscosity of (b5) the liquid polymer is a value measured according to JIS K2283-2000 at 100° C. or 40° C.

The number average molecular weight of (b5) the liquid polymer is preferably 650 or more, more preferably 700 or more, and even more preferably 750 or more, and is preferably 2800 or less, more preferably 2500 or less, and even more preferably 2000 or less. It is noted that the number average molecular weight is measured by gel permeation chromatography ("HLC-8120GPC" available from Tosoh corporation) using a differential refractometer as a detector under conditions of a column: GMHHXL (available from Tosoh corporation), a column temperature: 40° C., and an eluent: tetrahydrofuran, and is a conversion value based on standard polystyrene.

According to the present disclosure, at least one cover layer of the golf ball is formed from a cover composition containing (A) the base resin and the component (B) as the resin component. The cover layer containing (A) the base resin and the component (B) contains the component (B) preferably in an amount of 0.1 part by mass or more, more preferably in an amount of 0.5 part by mass or more, and even more preferably in an amount of 1.0 part by mass or more, and preferably in an amount of 30 parts by mass or less, more preferably in an amount of 20 parts by mass or less, and even more preferably in an amount of 10 parts by mass or less, with respect to 100 parts by mass of (A) the base resin. If the amount of the component (B) is 0.1 part by mass or more, the obtained golf ball has higher resilience, and if the amount of the component (B) is 30 parts by mass or less, the release property of molding the golf ball is not affected.

In the case that the golf ball according to the present disclosure comprises a plurality of cover layers, at least one cover layer contains (A) the base resin and the component (B), and the layer not containing (A) the base resin and the component (B) may contain other resin components.

Examples of the other resins include a thermoplastic resin such as a polyurethane, an ionomer resin, a polyamide and a polyethylene; and a thermoplastic elastomer such as a styrene elastomer, a polyolefin elastomer, a polyurethane elastomer, a polyamide elastomer and a polyester elastomer.

Specific examples of the other resins include an ionomer resin having a trade name of "Himilan (registered trademark)" available from Mitsui-Du Pont Polychemicals Co., Ltd., a thermoplastic polyurethane elastomer having a trade name of "Elastollan (registered trademark)" available from BASF Japan Ltd., a thermoplastic polyamide elastomer having a trade name of "Pebax (registered trademark)" available from Arkema K. K., a thermoplastic polyester elastomer having a trade name of "Hytrel (registered trademark)" available from Du Pont-Toray Co., Ltd., and a thermoplastic styrene elastomer having a trade name of "Tefabloc" or a thermoplastic polyester elastomer having a trade name of "Tefabloc" available from Mitsubishi Chemical Corporation.

The total amount of (A) the base resin and the component (B) respective to all the resin components in the cover layer containing (A) the base resin and the component (B) is preferably 60 mass % or more, more preferably 70 mass % or more, and even more preferably 80 mass % or more. If the total amount is 60 mass % or more, the obtained golf ball has further enhanced resilience. The upper limit of the total amount is not particularly limited, and is preferably 100 mass %.

The cover of the golf ball according to the present disclosure may further contain a pigment component such as a white pigment (e.g. titanium oxide), a blue pigment and a red pigment, a weight adjusting agent such as calcium carbonate and barium sulfate, a dispersant, an antioxidant, an ultraviolet absorber, a light stabilizer, a fluorescent material or fluorescent brightener, unless they impair the performance of the cover.

In the present disclosure, the material hardness of the cover layer containing (A) the base resin and the component (B) is preferably 59 or more, more preferably 60 or more, and even more preferably 61 or more, and is preferably 69 or less, more preferably 68 or less, and even more preferably 67 or less in Shore D hardness. If the material hardness is 59 or more in Shore D hardness, lowering in the resilience of the obtained golf ball can be suppressed. In addition, if the material hardness is 69 or less in Shore D hardness, the obtained golf ball has better shot feeling. It is noted that the material hardness of the cover layer containing (A) the base resin and the component (B) is a slab hardness obtained by molding the cover composition containing (A) the base resin and the component (B) into a sheet form and measuring the hardness of the sheet.

The spherical core of the golf ball according to the present disclosure is preferably formed from a resin composition or a rubber composition, and more preferably formed from a rubber composition. The spherical core may be formed, for example, by heat pressing a rubber composition (hereinafter, sometimes simply referred to as "core rubber composition") containing a base rubber, a co-crosslinking agent, and a crosslinking initiator.

As the base rubber, particularly preferred is a high cis-polybutadiene having a cis-bond which is beneficial to the resilience in an amount of 40 mass % or more, preferably 70 mass % or more, and more preferably 90 mass % or more. As the co-crosslinking agent, an $\alpha,\beta$-unsaturated carboxylic acid having 3 to 8 carbon atoms or a metal salt thereof is preferred, and an acrylic acid metal salt and an methacrylic acid metal salt are more preferred. As the metal constituting the metal salt, zinc, magnesium, calcium, aluminum and sodium are preferred, and zinc is more preferred. The amount of the co-crosslinking agent is preferably 15 parts by mass or more and 50 parts by mass or less with respect to 100 parts by mass of the base rubber. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy) hexane, and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

The core rubber composition may further contain an organic sulfur compound. Examples of the organic sulfur compound include compounds belonging to diphenyl disulfides (e.g. diphenyl disulfides, bis(pentabromophenyl) disulfides), thiophenols and thionaphthols. The amount of the organic sulfur compound is preferably 0.01 part by mass or more, more preferably 0.05 part by mass or more, and is preferably 5.0 parts by mass or less, more preferably 3.0 parts by mass or less, with respect to 100 parts by mass of the base rubber. The core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, either or both of an aliphatic carboxylic acid (e.g. caprylic acid) and an aromatic carboxylic acid (e.g. benzoic acid) may be used. The amount of the carboxylic acid and/or the salt thereof is 1 part by mass or more and 40 parts by mass or less with respect to 100 parts by mass of the base rubber.

The core rubber composition may appropriately contain a weight adjusting agent such as zinc oxide and barium sulfate, an antioxidant, or a colored powder, in addition to the base rubber, the co-crosslinking agent, the crosslinking initiator, and the organic sulfur compound.

[Construction of Golf Ball]

The construction of the golf ball according to the present disclosure is not particularly limited, as long as the golf ball comprises a spherical core, and a cover covering the spherical core and composed of one or more layers. Examples of the construction of the golf ball include a two-piece golf ball composed of a single-layered spherical core and a single-layered cover covering the spherical core wherein the single-layered cover contains (A) the base resin and the component (B); a three-piece golf ball composed of a single-layered spherical core, an inner cover layer covering the spherical core and an outer cover layer covering the inner cover layer wherein either or both of the inner cover layer and the outer cover layer contain (A) the base resin and the component (B); a multi-piece golf ball (e.g. a four-piece golf ball, a five-piece golf ball) composed of a single-layered spherical core, two or more inner cover layers covering the spherical core and an outermost cover layer covering the inner cover layers wherein at least one layer of the two or more inner cover layers contains (A) the base resin and the component (B); and a multi-piece golf ball (e.g. a four-piece golf ball, a five-piece golf ball) composed of a single-layered spherical core, two or more inner cover layers covering the spherical core and an outermost cover layer covering the inner cover layers wherein the outermost cover layer contains (A) the base resin and the component (B).

In the multi-piece golf ball (e.g. four-piece golf ball, five-piece golf ball) composed of a single-layered spherical core, two or more inner cover layers covering the spherical core and an outermost cover layer covering the inner cover layers wherein at least one layer of the two or more inner cover layers contains (A) the base resin and the component (B), the outermost layer of the inner cover layers preferably contains (A) the base resin and the component (B), and all layers of the inner cover layers may contain (A) the base resin and the component (B).

In the multi-piece golf ball (e.g. four-piece golf ball, five-piece golf ball) composed of a single-layered spherical core, two or more inner cover layers covering the spherical core and an outermost cover layer covering the inner cover layers wherein the outermost cover layer contains (A) the base resin and the component (B), at least one layer of the two or more inner cover layers may contain (A) the base resin and the component (B). In this case, the outermost layer of the inner cover layers preferably contains (A) the base resin and the component (B), and all layers of the inner cover layers may contain (A) the base resin and the component (B).

The spherical core of the golf ball according to the present disclosure preferably has a diameter of 37.0 mm or more, more preferably 37.5 mm or more, and even more preferably 38.0 mm or more, and preferably has a diameter of 42.2 mm or less, more preferably 41.8 mm or less, even more preferably 41.5 mm or less, and most preferably 41.0 mm or less. If the diameter of the spherical core is 37.0 mm or more, the thickness of the cover does not become too thick and thus the resilience becomes better. On the other hand, if the diameter of the spherical core is 42.2 mm or less, the thickness of the cover does not become too thin and thus the cover functions better.

When the spherical core has a diameter in a range from 37.0 mm to 42.2 mm, the compression deformation amount of the spherical core (shrinking amount of the spherical core along the compression direction) when applying a load from 98 N as an initial load to 1275 N as a final load to the spherical core is preferably 2.0 mm or more, more preferably 2.1 mm or more, and even more preferably 2.2 mm or more, and is preferably 5.0 mm or less, more preferably 4.9 mm or less, and even more preferably 4.8 mm or less. If the compression deformation amount is 2.0 mm or more, the shot feeling becomes better, and if the compression deformation amount is 5.0 mm or less, the resilience becomes higher.

The thickness of the cover of the golf ball according to the present disclosure is preferably 0.5 mm or more, more preferably 0.7 mm or more, and even more preferably 0.9 mm or more, and is preferably 4.0 mm or less, more preferably 3.0 mm or less, and even more preferably 2.0 mm or less. This is because if the thickness of the cover falls within the above range, lowering in the durability or abrasion resistance of the cover can be further suppressed. It is noted that when the cover has a plurality of layers, it is preferred that the total thickness of the cover layers falls within the above range.

In the case that the golf ball according to the present disclosure has two or more inner cover layers and the outermost cover layer, the total thickness of the inner cover layers is preferably 0.5 mm or more, more preferably 0.6 mm or more, and even more preferably 0.7 mm or more, and is preferably 4.0 mm or less, more preferably 3.5 mm or less, and even more preferably 3.0 mm or less. In addition, the thickness of each layer of the inner cover layers is preferably 0.3 mm or more, more preferably 0.4 mm or more, and even more preferably 0.5 mm or more, and is preferably 2.0 mm or less, more preferably 1.8 mm or less, and even more preferably 1.6 mm or less.

The thickness of the outermost cover layer is preferably 4.0 mm or less, more preferably 3.0 mm or less, and even more preferably 2.0 mm or less, and is preferably 0.3 mm or more, more preferably 0.4 mm or more, and even more preferably 0.5 mm or more. This is because if the thickness of the outermost cover layer falls within the above range, the obtained golf ball has better resilience or shot feeling.

The total number of the dimples formed on the cover is preferably 200 or more and 500 or less. If the total number of the dimples is less than 200, the dimple effect is hardly obtained. In addition, if the total number of the dimples exceeds 500, the dimple effect is hardly obtained because the size of the respective dimples is small. The shape (shape in a plan view) of the dimples includes, but is not limited to, a circle, a polygonal shape such as a roughly triangular shape, a roughly quadrangular shape, a roughly pentagonal shape and a roughly hexagonal shape, and other irregular shape. The shape of the dimples may be employed solely or at least two of them may be used in combination.

The golf ball according to the present disclosure preferably has a diameter in a range from 40 mm to 45 mm. In light of satisfying a regulation of US Golf Association (USGA), the diameter is particularly preferably 42.67 mm or more. In light of prevention of air resistance, the diameter is more preferably 44 mm or less, and particularly preferably 42.80 mm or less. In addition, the golf ball according to the present disclosure preferably has a mass in a range from 40 g to 50 g. In light of obtaining greater inertia, the mass is more preferably 44 g or more, and particularly preferably 45.00 g or more. In light of satisfying a regulation of USGA, the mass is particularly preferably 45.93 g or less.

When the golf ball according to the present disclosure has a diameter in a range from 40 mm to 45 mm, the compression deformation amount of the golf ball (shrinking amount of the golf ball along the compression direction) when applying a load from 98 N as an initial load to 1275 N as a final load to the golf ball is preferably 2.0 mm or more, more preferably 2.4 mm or more, even more preferably 2.5 mm or more, and most preferably 2.8 mm or more, and is preferably 5.0 mm or less, more preferably 4.5 mm or less. If the compression deformation amount is 2.0 mm or more, the golf ball does not become too hard and thus the shot feeling thereof becomes better. On the other hand, if the compression deformation amount is 5.0 mm or less, the resilience of the golf ball becomes higher.

[Method for Producing Golf Ball]

The spherical core of the golf ball according to the present disclosure may be molded, for example, by heat pressing the spherical core rubber composition. The molding conditions for heat pressing the core rubber composition may be determined appropriately depending on the rubber formulation. Generally, the heat pressing is preferably carried out at a temperature ranging from 130° C. to 200° C. for 10 to 60 minutes, or carried out in a two-step heating of heating at a temperature ranging from 130° C. to 150° C. for 20 to 40 minutes followed by heating at a temperature ranging from 160° C. to 180° C. for 5 to 15 minutes.

Examples of the method for molding the cover of the golf ball according to the present disclosure include a method which comprises molding the cover composition into a hollow shell, covering the core with a plurality of the hollow shells and subjecting the core with a plurality of the hollow shells to the compression molding (preferably a method which comprises molding the cover composition into a hollow half shell, covering the spherical core with two of the hollow half shells, and subjecting the spherical core with two of the hollow half shells to the compression molding); and a method which comprises injection molding the cover composition directly onto the spherical core. The cover of the golf ball according to the present disclosure is preferably molded by the injection molding method. This is because if the injection molding method is adopted, the cover can be produced more easily.

When molding the cover in the compression molding method, molding of the half shell may be conducted by either a compression molding method or an injection molding method, but the compression molding method is preferred. The compression molding of the cover composition into the half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of the method for molding the cover using half shells include a method of covering the spherical core with two of the half shells and then subjecting the spherical core with two of the half shells to the compression molding. The compression molding of the half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a golf ball cover having a uniform thickness can be formed.

In case of injection molding the cover composition into the cover, the cover composition extruded in a pellet form may be used for the injection molding, or the cover materials such as the base resin components and the pigment may be dry blended, followed by directly injection molding the blended material. It is preferred to use upper and lower molds having a hemispherical cavity and pimples for forming the cover, wherein a part of the pimples also serves as a retractable hold pin. When molding the cover by the injection molding, for example, the hold pin is protruded to hold the core, and the cover composition is charged and cooled to obtain the cover. For example, the molding of the cover may be conducted as follows: the cover composition heated to a temperature ranging from 200° C. to 250° C. is charged for 0.5 to 5 seconds into a mold held under a pressure of 9 MPa to 15 MPa, and cooled for 10 to 60 seconds, and the mold is opened to eject the golf ball.

In case of using an injection molding machine having an injection molding apparatus and a molding mold to mold the cover, the temperature at the cylinder (barrel) portion of the injection molding apparatus (setting temperature of the apparatus) is preferably 200° C. or more, more preferably 210° C. or more, and is preferably 270° C. or less, more preferably 260° C. or less. If the temperature at the cylinder (barrel) portion falls within the above range, the fluidity of the cover composition is maintained.

The golf ball body having the cover formed thereon is ejected from the mold, and is preferably subjected to surface treatments such as deburring, cleaning and sandblast where necessary. In addition, if desired, a paint film or a mark may be formed. The paint film preferably has a thickness of, but is not particularly limited to, 5 μm or more, more preferably 7 μm or more, and preferably has a thickness of 50 μm or less, more preferably 40 μm or less, and even more preferably 30 μm or less. This is because if the thickness of the paint film is less than 5 μm, the paint film is easy to wear off due to the continued use of the golf ball, and if the thickness of the paint film exceeds 50 μm, the dimple effect is reduced and thus the flight performance of the golf ball may be lowered.

Figure 2:
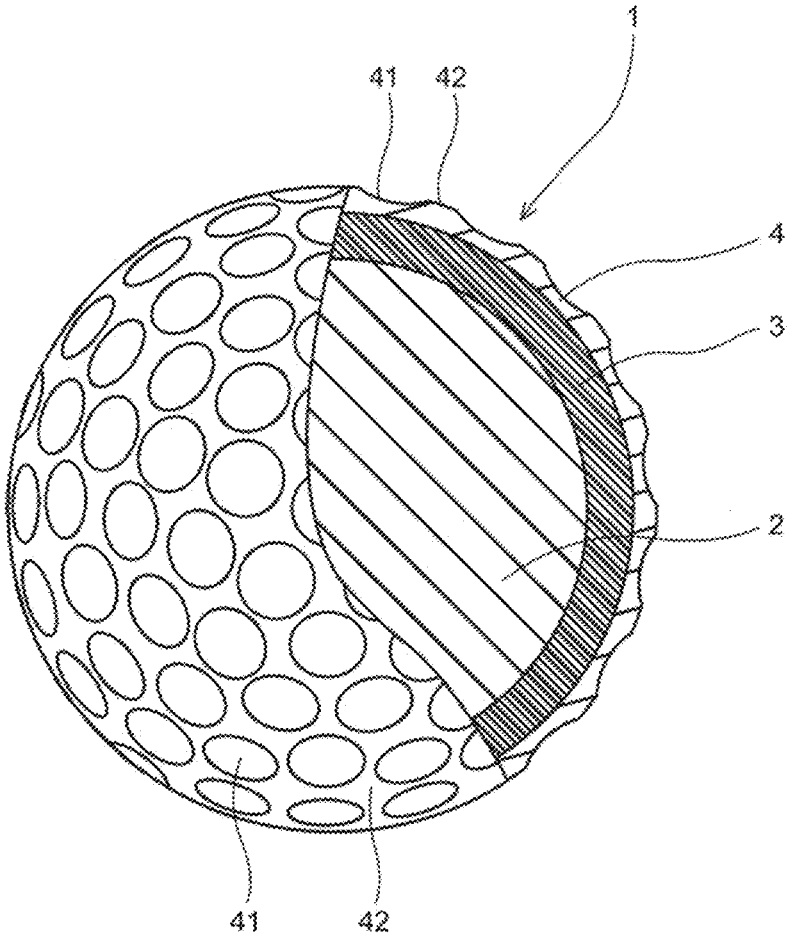
FIG. 2 is a partially cutaway cross-sectional view of a golf ball according to one embodiment of the present disclosure.

FIG. 2 is a partially cutaway sectional view showing a golf ball 1 according to an embodiment of the present disclosure. The golf ball 1 comprises a spherical core 2, an inner cover layer 3 disposed outside the spherical core 2, and an outer cover layer 4 disposed outside the inner cover layer 3. A plurality of dimples 41 are formed on the surface of the outer cover layer 4. Other portions than the dimples 41 on the surface of the outer cover layer 4 are lands 42. In a preferable embodiment of the present disclosure, the outer cover layer 4, the inner cover layer 3, or both of the outer cover layer 4 and the inner cover layer 3 contains (A) the base resin and the component (B).

EXAMPLES

Next, the present disclosure will be described in detail by way of examples. However, the present disclosure is not limited to the examples described below.

Various changes and modifications without departing from the spirit of the present disclosure are included in the scope of the present disclosure.

[Evaluation Method]

(1) Analysis of Surface Morphology of Cover Cut Plane

A shape analyzing laser microscope Vk-X100 available from Keyence corporation was used to analyze the surface morphology of the cover cut plane. According to the formulations shown in Table 2, the materials were mixed with a twin-screw kneading extruder to prepare cover compositions in a pellet form. The extruding conditions for the cover compositions were a screw diameter of 45 mm, a screw rotational speed of 200 rpm and screw L/D=35, and the mixture was heated to 160° C. to 230° C. at the die position of the extruder. The obtained cover compositions were heat-pressed at a temperature of 170° C. for ten minutes in vacuum to prepare slabs having a thickness of 2.0 mm, a length of 130 mm and a width of 130 mm. The slab was cut with a razor to expose the inner side of the slab. The obtained cut plane was observed to obtain the arithmetic mean roughness Sa of the surface and the arithmetic mean peak curvature Spc of the peaks. It is noted that the arithmetic mean roughness Sa of the surface and the arithmetic mean peak curvature Spc of the peaks were shown as an average value of three-time measurements.

Measuring condition:

Magnification: smooth surface was observed by 100 times magnification

Image processing: waviness removal

Smoothing: median size 3×3

Primary plane setting→plane shape correction (plane slope correction→waviness removal×2 (intensity 20))

(2) Compression Deformation Amount (mm)

The deformation amount of the core along the compression direction (shrinking amount of the core along the compression direction), when applying a load from an initial load of 98 N to a final load of 1275 N to the core, was measured.

(3) Material Hardness (Shore D Hardness)

Sheets with a thickness of about 2 mm were produced by injection molding (cylinder temperature: 230° C.) the cover composition. The sheets were stored at a temperature of 23° C. for two weeks. At least three of these sheets were stacked on one another so as not to be affected by the measuring substrate on which the sheets were placed, and the hardness of the stack was measured with an automatic hardness tester (Digitest II, available from Bareiss company) using a testing device of "Shore D". It is noted that when measuring the material hardness of the cover composition, a composition obtained by blending predetermined materials (the component (B), titanium dioxide and so on) into (A) the base resin is used for the measurement.

(4) Shot Feeling

An actual hitting test was carried out by ten amateur golfers (high skilled persons) using a driver. In accordance with the following standard, the feeling of hitting the golf ball was evaluated by each golfer. The shot feeling most evaluated by the ten golfers was adopted as the shot feeling of that golf ball.

Evaluation Standard

G (Good): Impact is low and feeling is good.

F (Fair): Fair.

P (Poor): Impact is great and feeling is bad.

(5) Coefficient of Restitution

A metal cylindrical object with a mass of 198.4 g was allowed to collide with each golf ball at a speed of 40 m/sec, and the speeds of the cylindrical object and the golf ball before and after the collision were measured. Based on these speeds and the mass of each object, the coefficient of restitution of each golf ball was calculated. The measurement was conducted using twelve samples for each golf ball, and the average value thereof was adopted as the coefficient of restitution for that golf ball. It is noted that the coefficient of restitution of the golf ball No. 11 was defined as 100, and the coefficient of restitution of each golf ball was represented by converting the coefficient of restitution of each golf ball into this index.

(6) Durability

A test using an air gun to allow each golf ball to collide with a metal plate at a speed of 45 m/sec for 150 times was conducted. The test was conducted using twelve balls for each golf ball.

Evaluation Standard

E (Excellent): The golf balls were not damaged by the above 150 time-collision test and not damaged by the additional 20 time-collision test.

G (Good): No ball among twelve golf balls was damaged.

F (Fair): One ball among twelve golf balls was damaged.

P (Poor): Two or more balls among twelve golf balls were damaged.

(7) Analysis of Surface Morphology of Cover Cut Plane

According to the formulations shown in Table 2, the materials were mixed with a twin-screw kneading extruder to prepare cover compositions in a pellet form for the golf ball No. 3, 7, 11. The extruding conditions for the cover compositions were a screw diameter of 45 mm, a screw rotational speed of 200 rpm and screw L/D=35, and the mixture was heated to 160° C. to 230° C. at the die position of the extruder. The obtained cover compositions for the golf balls No. 3, 7, 11 were heat-pressed at a temperature of 170° C. for ten minutes in vacuum to prepare slabs having a thickness of 2.0 mm, a length of 130 mm and a width of 130 mm. The slab was cut with a razor to expose the inner side of the slab. The obtained cut plane was observed with a shape analyzing laser microscope Vk-X100 available from Keyence corporation.

[Production of Golf Ball]

(1) Production of Spherical Core

According to the formulations shown in Table 1, the rubber compositions were kneaded, and heat pressed in upper and lower molds, each having a hemispherical cavity, to produce spherical cores. It is noted that barium sulfate was appropriately added such that the obtained golf ball had a mass of 45.6 g.

TABLE 1

| Rubber composition No. | | A |
|---|---|---|
| Formulation (parts by-mass) | Polybutadiene rubber | 100 |
| | Zinc acrylate | 32 |
| | Zinc oxide | 5 |
| | Barium sulfate | Appropriate amount* |
| | Dicumyl peroxide | 0.7 |
| | Diphenyldisulfide | 0.5 |
| Molding condition | Molding temperature (° C.) | 170 |
| | Molding time (min) | 15 |
| Core diameter (mm) | | 39.8 |
| Compression deformation amount (mm) | | 3.6 |

*As to the amount of barium sulfate, adjustment was made such that the golf ball had a mass of 45.6 g.

Polybutadiene rubber "BR730 (high-cis polybutadiene)" available from JSR Corporation Zinc acrylate: "ZNDA-90S" available from Nisshoku Techno Fine Chemical Co., Ltd.

Zinc oxide: "Ginrei (registered trademark) R" available from Toho Zinc Co., Ltd.

Barium sulfate: "Barium Sulfate BD" available from Sakai Chemical Industry Co., Ltd.

Dicumyl peroxide: "PERCUMYL (registered trademark) D" available from NOF Corporation Diphenyldisulfide: available from Sumitomo Seika Chemicals Co., Ltd.

(2) Production of Cover

According to the formulations shown in Table 2, the materials were mixed with a twin-screw kneading extruder to prepare cover compositions in a pellet form. The extruding conditions for the cover compositions were a screw diameter of 45 mm, a screw rotational speed of 200 rpm and screw L/D=35, and the mixture was heated to 160° C. to 230° C. at the die position of the extruder.

When molding the cover, the hold pin was protruded to hold the spherical core, the cover composition heated to 260° C. was charged for 0.3 second into a mold held under a pressure of 80 tons, and cooled for 30 seconds, and the mold was opened to eject the golf balls. The surface of the obtained golf ball bodies was subjected to a sandblast treatment, and a mark was formed thereon. Then, a clear paint was applied to the golf ball bodies, and the paint was dried in an oven of 40° C. to obtain golf balls having a diameter of 42.7 mm and a mass of 45.6 g.

TABLE 2

| | | | Golf ball No. | | | | | | |
|---|---|---|---|---|---|---|---|---|---|
| | | | 1 | 2 | 3 | 4 | 5 | 6 | 7 |
| Spherical core | Rubber composition No. | | A | A | A | A | A | A | A |
| | Diameter (mm) | | 39.8 | 39.8 | 39.8 | 39.8 | 39.8 | 39.8 | 39.8 |
| Cover formulation (parts by mass) | (A) Base resin | Himilan #1555 | 30 | 30 | 30 | 30 | 30 | 30 | 30 |
| | | Himilan #1605 | 20 | 20 | 20 | 20 | 20 | 20 | 20 |
| | | Himilan AM7329 | 50 | 50 | 50 | 50 | 50 | 50 | 50 |
| | (b1) | (1) SH3400P | 3 | — | — | — | — | — | — |

TABLE 2-continued

| | | | | | | | | | |
|---|---|---|---|---|---|---|---|---|---|
| | Polyrotaxane | (2) SH2400P | — | 3 | — | — | — | — | — |
| | | (3) SH1300P | — | — | 1 | — | — | — | — |
| | (b2) | (1) 3350 | — | — | — | 5 | — | — | — |
| | Polyethylene | (2) 35000 | — | — | — | — | 2 | 5 | 10 |
| | oxide | (3) 300000 | — | — | — | — | — | — | — |
| | | (4) 2000000 | — | — | — | — | — | — | — |
| | Titanium dioxide | | 3 | 3 | 3 | 3 | 3 | 3 | 3 |
| | Thickness (mm) | | 1.45 | 1.45 | 1.45 | 1.45 | 1.45 | 1.45 | 1.45 |
| | Material hardness (Shore D) | | 64 | 63 | 64 | 61 | 62 | 62 | 61 |
| Ball | Coefficient of restitution | | 100 | 100 | 100 | 100 | 100 | 100 | 100 |
| performance | Shot feeling | | F | G | F | G | G | G | G |
| | Durability | | G | G | G | E | E | E | E |
| Fine | Sa (μm) | | 0.07 | 0.06 | 0.05 | 0.10 | 0.07 | 0.14 | 0.15 |
| dispersion | Spc ($mm^{-1}$) | | 1671 | 2160 | 2439 | 2901 | 2283 | 4608 | 5012 |
| | Sa × Spc (μm/mm) | | 120 | 139 | 117 | 285 | 168 | 641 | 762 |

| | | | Golf ball No. | | | | | |
|---|---|---|---|---|---|---|---|---|
| | | | 8 | 9 | 10 | 11 | 12 | 13 |
| Spherical | Rubber composition No. | | A | A | A | A | A | A |
| core | Diameter (mm) | | 39.8 | 39.8 | 39.8 | 39.8 | 39.8 | 39.8 |
| Cover | (A) | Himilan #1555 | 30 | 30 | 30 | 30 | 30 | 30 |
| formulation | Base resin | Himilan #1605 | 20 | 20 | 20 | 20 | 20 | 20 |
| (parts | | Himilan AM7329 | 50 | 50 | 50 | 50 | 50 | 50 |
| by mass) | (b1) | (1) SH3400P | — | — | — | — | 1 | — |
| | Polyrotaxane | (2) SH2400P | — | — | — | — | — | 1 |
| | | (3) SH1300P | — | — | 0.5 | — | — | — |
| | (b2) | (1) 3350 | — | — | — | — | — | — |
| | Polyethylene | (2) 35000 | — | — | — | — | — | — |
| | oxide | (3) 300000 | 5 | — | 5 | — | — | — |
| | | (4) 2000000 | — | 5 | — | — | — | — |
| | Titanium dioxide | | 3 | 3 | 3 | 3 | 3 | 3 |
| | Thickness (mm) | | 1.45 | 1.45 | 1.45 | 1.45 | 1.45 | 1.45 |
| | Material hardness (Shore D) | | 63 | 64 | 64 | 64 | 64 | 64 |
| Ball | Coefficient of restitution | | 100 | 100 | 100 | 100 | 100 | 100 |
| performance | Shot feeling | | G | F | G | P | F | F |
| | Durability | | E | E | E | F | F | F |
| Fine | Sa (μm) | | 0.09 | 0.09 | 0.14 | 0.05 | 0.04 | 0.05 |
| dispersion | Spc ($mm^{-1}$) | | 2744 | 2962 | 4365 | 1247 | 1357 | 1473 |
| | Sa × Spc (μm/mm) | | 260 | 281 | 627 | 56 | 59 | 70 |

Himilan 1555: sodium ion-neutralized ethylene-methacrylic acid binary copolymer ionomer resin (melt flow rate (190° C., 2.16 kgf): 10 g/10 min, bending stiffness: 240 MPa, material hardness: 60 (Shore D)) available from Du Pont-Mitsui Polychemicals Co., Ltd.
Himilan 1605: sodium ion-neutralized ethylene-methacrylic acid binary copolymer ionomer resin (melt flow rate (190° C., 2.16 kgf): 3 g/10 min, bending stiffness: 320 MPa, material hardness: 65 (Shore D)) available from Du Pont-Mitsui Polychemicals Co., Ltd.
Himilan AM7329: zinc ion-neutralized ethylene-methacrylic acid binary copolymer ionomer resin (melt flow rate (190° C., 2.16 kgf): 5 g/10 min, bending stiffness: 221 MPa, material hardness: 64 (Shore D)) available from Du Pont-Mitsui Polychemicals Co., Ltd.
SH1300P: polyrotaxane "SeRM (registered trademark) super polymer SH1300P (a polyrotaxane having a cyclodextrin with at least a part of hydroxyl groups thereof being modified with a caprolactone chain via a —O—$C_3H_6$—O— group, linear molecule: polyethylene glycol, blocking group: adamantyl group, molecular weight of linear molecule: 11,000, hydroxyl value of polyrotaxane: 40 mgKOH/g, total molecular weight of polyrotaxane: 190,000 in weight average molecular weight)" available from Advanced Softmaterials Inc.
SH2400P: polyrotaxane "SeRM (registered trademark) super polymer SH2400P (a polyrotaxane having a cyclodextrin with at least a part of hydroxyl groups thereof being modified with a caprolactone chain via a —O—$C_3H_6$—O— group, linear molecule: polyethylene glycol, blocking group: adamantyl group, molecular weight of linear molecule: 20,000, hydroxyl value of polyrotaxane: 76 mgKOH/g, total molecular weight of polyrotaxane: 400,000 in weight average molecular weight)" available from Advanced Softmaterials Inc.
SH3400P: polyrotaxane "SeRM (registered trademark) super polymer SH3400P (a polyrotaxane having a cyclodextrin with at least a part of hydroxyl groups thereof being modified with a caprolactone chain via a —O—$C_3H_6$—O— group, linear molecule: polyethylene glycol, blocking group: adamantyl group, molecular weight of linear molecule: 35000, hydroxyl value of polyrotaxane: 72.0 mgKOH/g, total molecular weight of polyrotaxane: 700,000 in weight average molecular weight)" available from Advanced Softmaterials Inc.
Polyethylene oxide 3350: available from Sigma-Aldrich Co. LLC
Polyethylene oxide 35000: available from Sigma-Aldrich Co. LLC
Polyethylene oxide 300000: available from Sigma-Aldrich Co. LLC
Polyethylene oxide 2000000: available from Sigma-Aldrich Co. LLC
Titanium dioxide: "A220" available from Ishihara Sangyo Kaisha, Ltd.

Evaluation results regarding the obtained golf balls are shown in Table 2. It can be seen from the results shown in Table 2 that the golf ball according to the present disclosure comprising a spherical core, and a cover composed of one or more layers and disposed outside the spherical core, wherein at least one cover layer contains (A) a base resin, and (B) at least one member selected from the group consisting of a polyrotaxane, a polyethylene oxide, a polypropylene oxide, a polycaprolactone and a liquid polymer, and Sa×Spc≥100 is satisfied wherein Sa (μm) is an arithmetic mean roughness of a surface of a cut plane of the cover, and Spc ($mm^{-1}$) is an arithmetic mean peak curvature of peaks of the surface of the cut plane of the cover, has good shot feeling and excellent durability and not having lowered resilience.

Figure 3:
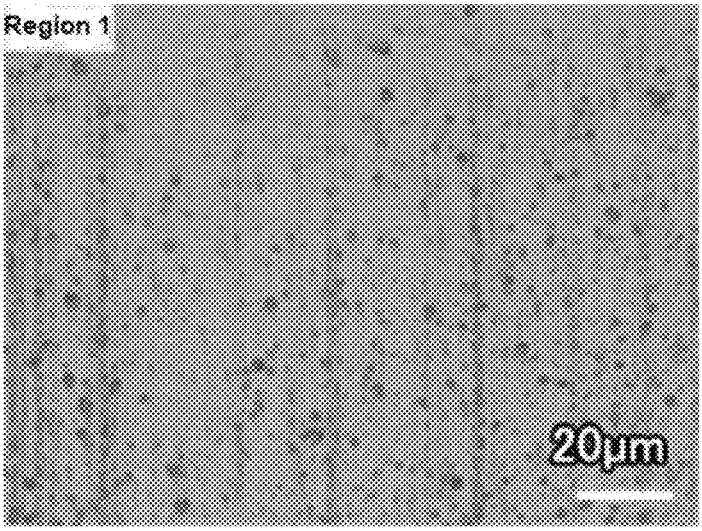
FIG. 3 is an electron microscope photograph of a cover cut plane of a golf ball according to one embodiment of the present disclosure.
Figure 4:
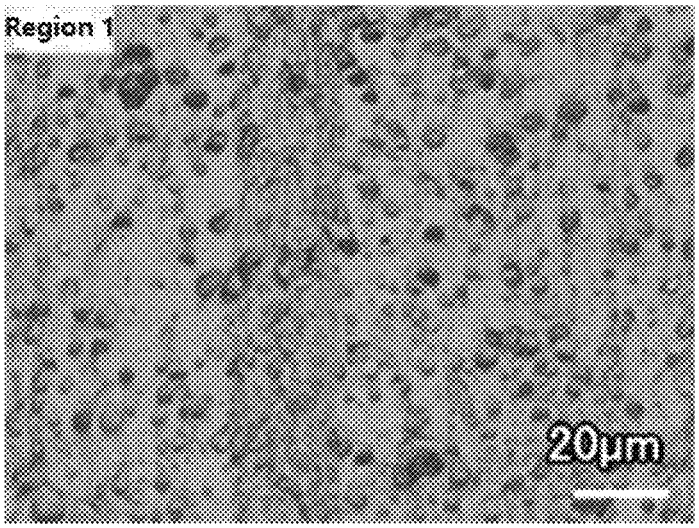
FIG. 4 is an electron microscope photograph of a cover cut plane of a golf ball according to one embodiment of the present disclosure.
Figure 5:
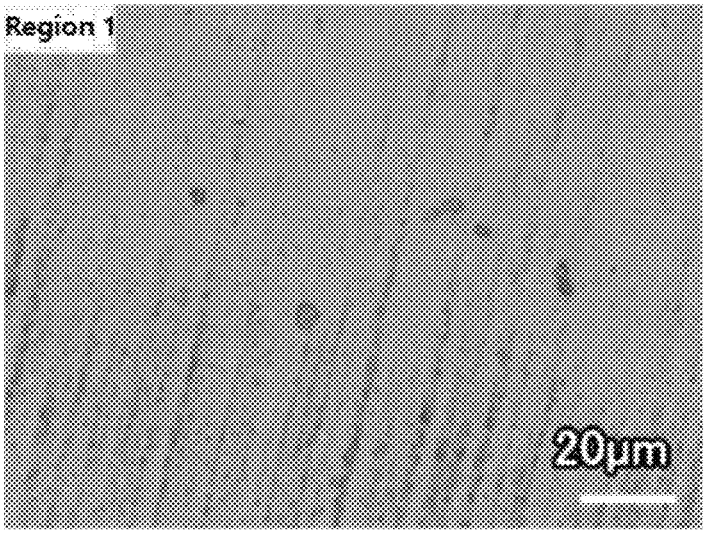
FIG. 5 is an electron microscope photograph of a cover cut plane of a golf ball according to one embodiment of the present disclosure.

FIG. 3 and FIG. 4 are electron microscope photographs of the surface of the cover cut plane of the golf balls No. 3 and No. 7 according to the present disclosure. It can be seen from FIG. 3 and FIG. 4 that the component (B) which is the additive is finely dispersed in (A) the base resin. FIG. 5 is the case where the cover contains only (A) the base resin and does not contain the component (B) which is the additive (golf ball No. 11), and no dispersion deriving from the component (B) was found.

The golf ball according to the present disclosure has good shot feeling and excellent durability and not having lowered resilience.

The golf ball according to the present disclosure (1) is a golf ball comprising a spherical core, and a cover disposed outside the spherical core and composed of one or more layers, wherein at least one cover layer contains (A) a base resin, and (B) at least one member selected from the group consisting of a polyrotaxane, a polyethylene oxide, a polypropylene oxide, a polycaprolactone and a liquid polymer, and Sa×Spc≥100 is satisfied wherein Sa (μm) is an arithmetic mean roughness of a surface of a cut plane of the cover, and Spc ($mm^{-1}$) is an arithmetic mean peak curvature of peaks of the surface of the cut plane of the cover.

The golf ball according to the present disclosure (2) is the golf ball according to the present disclosure (1), wherein an amount of the component (B) is 0.1 part by mass or more and 30 parts by mass or less with respect to 100 parts by mass of (A) the base resin.

The golf ball according to the present disclosure (3) is the golf ball according to the present disclosure (1) or (2), wherein the component (B) includes the polyrotaxane and/or the polyethylene oxide.

The golf ball according to the present disclosure (4) is the golf ball according to any one of the present disclosures (1) to (3), wherein the polyethylene oxide has a number average molecular weight of 400 or more and 7,000,000 or less.

The golf ball according to the present disclosure (5) is the golf ball according to any one of the present disclosures (1) to (4), wherein the polyrotaxane has a cyclodextrin, a linear molecule piercing through the cyclic structure of the cyclodextrin in a skewering manner, and blocking groups located at both terminals of the linear molecule to prevent disassociation of the cyclodextrin, wherein at least a part of hydroxyl groups of the cyclodextrin is modified with a caprolactone chain via —O—$C_3H_6$—O— group.

The golf ball according to the present disclosure (6) is the golf ball according to any one of the present disclosures (1) to (5), wherein the polyrotaxane has polyethylene glycol as a linear molecule and an adamantyl group as a blocking group.

The golf ball according to the present disclosure (7) is the golf ball according to any one of the present disclosures (1) to (6), wherein the cover layer containing (A) the base resin and the component (B) has a material hardness ranging from 59 to 69 in Shore D hardness.

The golf ball according to the present disclosure (8) is the golf ball according to any one of the present disclosures (1) to (7), wherein (A) the base resin includes an ionomer resin.

This application is based on Japanese Patent Application No. 2021-212721 filed on Dec. 27, 2021, the content of which is hereby incorporated by reference.

The invention claimed is:

1. A golf ball comprising a spherical core, and a golf ball cover composed of one or more cover layers and disposed outside the spherical core, wherein at least one cover layer contains (A) a base resin, and (B) a component including at least one member selected from the group consisting of a polyethylene oxide, a polypropylene oxide, a polycaprolactone and a liquid polymer, and with respect to the golf ball cover, Sa×Spc≥100 is satisfied wherein Sa (μm) is an arithmetic mean roughness of a surface of a cut plane of the golf ball cover, and Spc ($mm^{-1}$) is an arithmetic mean peak curvature of peaks of the surface of the cut plane of the golf ball cover.

2. The golf ball according to claim 1, wherein an amount of the component (B) is 0.1 part by mass or more and 30 parts by mass or less with respect to 100 parts by mass of (A) the base resin.

3. The golf ball according to claim 1, wherein the component (B) includes polyethylene oxide, or includes polyethylene oxide and a polyrotaxane.

4. The golf ball according to claim 1, wherein the polyethylene oxide has a number average molecular weight of 400 or more and 7,000,000 or less.

5. The golf ball according to claim 3, wherein the polyrotaxane has a cyclodextrin, a linear molecule piercing through the cyclic structure of the cyclodextrin in a skewering manner, and blocking groups located at both terminals of the linear molecule to prevent disassociation of the cyclodextrin, wherein at least a part of hydroxyl groups of the cyclodextrin is modified with a caprolactone chain via —O—$C_3H_6$—O— group.

6. The golf ball according to claim 5, wherein the polyrotaxane has polyethylene glycol as the linear molecule and an adamantyl group as the blocking group.

7. The golf ball according to claim 1, wherein the cover layer containing (A) the base resin and the component (B) has a material hardness ranging from 59 to 69 in Shore D hardness.

8. The golf ball according to claim 1, wherein (A) the base resin includes an ionomer resin.

9. The golf ball according to claim 1, wherein 1000≥Sa×Spc≥100.

10. The golf ball according to claim 1, wherein 0.50≥Sa≥0.06.

11. The golf ball according to claim 1, wherein 10000≥Spc≥1300.

12. The golf ball according to claim 5, wherein the linear molecule has a weight average molecular weight ranging from 5,000 to 100,000.

13. The golf ball according to claim 5, wherein the polyrotaxane has a hydroxyl value ranging from 10 mg KOH/g to 400 mg KOH/g.

14. The golf ball according to claim 5, wherein the polyrotaxane has a total weight average molecular weight ranging from 30,000 to 3,000,000.

15. A golf ball comprising a spherical core, and a golf ball cover composed of one or more cover layers and disposed outside the spherical core, wherein at least one cover layer contains (A) a base resin and (B) a polyethylene oxide, an amount of the polyethylene oxide is 1.0 parts by mass or more and 10 parts by mass or less with respect to 100 parts by mass of (A) the base resin, and with respect to the golf ball cover, Sa×Spc≥100 is satisfied wherein Sa (μm) is an arithmetic mean roughness of a surface of a cut plane of the golf ball cover, and Spc (mm-1) is an arithmetic mean peak curvature of peaks of the surface of the cut plane of the golf ball cover.

16. A golf ball comprising a spherical core, and a golf ball cover composed of one or more cover layers and disposed outside the spherical core, wherein at least one cover layer contains (A) a base resin and (B) a polyrotaxane and a polyethylene oxide, a total amount of the polyrotaxane and the polyethylene oxide is 1.0 part by mass or more and 10 parts by mass or less with respect to 100 parts by mass of (A) the base resin, and with respect to the golf ball cover, Sa×Spc≥100 is satisfied wherein Sa (μm) is an arithmetic mean roughness of a surface of a cut plane of the golf ball cover, and Spc (mm-1) is an arithmetic mean peak curvature of peaks of the surface of the cut plane of the golf ball cover.

* * * * *